United States Patent [19]

Koller et al.

[11] Patent Number: 4,767,961

[45] Date of Patent: Aug. 30, 1988

[54] X-RAY GENERATOR COOLING SYSTEM

[75] Inventors: Thomas J. Koller, Shelton; John D. Weaver, Sr., Trumbull, both of Conn.

[73] Assignee: The Machlett Laboratories, Inc., Stamford, Conn.

[21] Appl. No.: 537,546

[22] Filed: Oct. 3, 1983

Related U.S. Application Data

[63] Continuation of Ser. No. 235,186, Feb. 17, 1981.

[51] Int. Cl.[4] ..... H01J 35/16; H01J 1/10

[52] U.S. Cl. ..... 313/12; 378/130; 378/141

[58] Field of Search ..... 313/12, 22, 23, 24, 313/34, 35; 378/130, 141

[56] References Cited

U.S. PATENT DOCUMENTS

| | | | |
|---|---|---|---|
| 1,656,826 | 1/1928 | Morrison | 313/12 |
| 1,987,790 | 1/1935 | Mutscheller | 378/141 |
| 2,873,954 | 2/1959 | Protze | 313/24 X |
| 2,886,724 | 5/1959 | Steen | 313/32 |
| 3,623,462 | 11/1971 | Anders | 123/41.54 |
| 3,982,059 | 9/1976 | Holland et al. | 174/73 |
| 3,989,102 | 11/1976 | Jaster et al. | 313/12 X |
| 4,107,562 | 8/1978 | Koller et al. | 313/59 |

*Primary Examiner*—David K. Moore
*Assistant Examiner*—Sandra L. O'Shea
*Attorney, Agent, or Firm*—John T. Meaney; Richard M. Sharkansky

[57] ABSTRACT

An X-ray generator system comprising a pressurized fluid source disposed for directing dielectric coolant fluid through a housing wherein an X-ray source may be electrically connected for generating X-rays, the system including a venturi device having a restricted passage through which the fluid flows and which is disposed in communication with portions of the housing where gas bubbles may accumulate in the fluid. Thus, the fluid flowing through the restricted passage of the venturi device produces a reduction in pressure which draws fluid from said portions of the housing so that any gas bubbles accumulated therein may be purged from the system.

11 Claims, 4 Drawing Sheets

X-RAY GENERATOR COOLING SYSTEM

This application is a continuation of application Ser. No. 235,186 filed Feb. 17, 1981.

BACKGROUND OF THE INVENTION

1. Field of the Invention

This invention relates generally to X-ray generator cooling apparatus and is concerned more particularly with a fluid-cooled X-ray generator system having means for purging foreign gaseous matter from the fluid.

2. Discussion of the Prior Art

A conventional X-ray generator may include a radiation shielded housing for enclosing an X-ray tube having an envelope wherein an electron emitting cathode is disposed for beaming electrons onto a spaced anode target with sufficient energy to generate X-rays. Generally, the housing is provided with a pair of mutually insulated connectors for feeding a selected electron emission current through the cathode and for applying appropriately high electron beaming voltages between the cathode and anode electrodes of the tube. Also, since a large portion of the electron energy beamed from the cathode onto the anode target is converted into heat, the housing may be connected to a pressurized source of dielectric coolant fluid, such as oil, for example, for circulating the fluid through the housing to carry heat away from the tube.

The fluid circulated through the housing is required to have suitable high dielectric properties for withstanding the high voltages applied between the cathode and anode electrodes of the X-ray tube. However, it has been found that bubbles or larger volumes of foreign gaseous matter, such as air, for example, may become immersed in the dielectric coolant fluid and reduce the dielectric properties of the fluid. The air can be introduced into the coolant fluid during installation, repair, or in general, whenever the fluid coolant apparatus is disconnected from the housing. Furthermore, it is possible that air may be drawn into the coolant oil due to differences in vertical heights causing a head pressure in portions of the coolant apparatus. Also, air may seep into the coolant fluid at joints or other connections during extended idle periods when air buildup can occur. In addition, X-rays in passage through the dielectric fluid generate a gas, such as hydrogen, for example, which also may be trapped in the fluid within the housing. Once inside the housing, the air or other foreign gaseous matter may migrate to critical portions of the housing, such as between the electrical connectors for the tube, for example, where electrical arcing may result and possibly damage the tube.

SUMMARY OF THE INVENTION

Accordingly, these and other disadvantages of the prior art are overcome by this invention providing a fluid cooled X-ray generator system with means for purging foreign gaseous matter from the coolant. The system includes a pressurized source, such as a pump and a reservoir, for example, of dielectric coolant fluid, such as oil, for example, which is transmissive to X-radiation. The pressurized source of coolant fluid is connected to a fluid conductive network including an X-ray generator housing wherein an X-ray tube may be disposed for operation. Preferably, the fluid conductive network is of the closed loop type whereby coolant fluid directed through the housing is returned to the source. Thus, the coolant fluid flowing through the housing, under pressure, carries heat away from the tube and delivers it to a heat sink, such as the reservoir, for example, where it may be safely dissipated.

In accordance with this invention, the fluid conductive network includes a venturi device which may be connected into the network internally or externally of the housing. The venturi device has a restricted passage disposed for having coolant fluid flow through it at reduced pressure in comparison to the rest of the network. The restricted passage of the venturi device communicates through suction tubing with portions of the housing, such as adjacent electrical connectors, for example, where bubbles of foreign gaseous matter tend to accumulate in the coolant fluid. Thus, the bubbles of gaseous matter are drawn into the suction tubing due to the reduction in pressure in the restricted passage, and are directed to a portion of the network, such as the reservoir, for example, where they may be purged from the system.

BRIEF DESCRIPTION OF THE DRAWINGS

For a better understanding of the invention, reference is made in the following detailed description to the drawings wherein.

DESCRIPTION OF THE PREFERRED EMBODIMENTS

Figure 1:
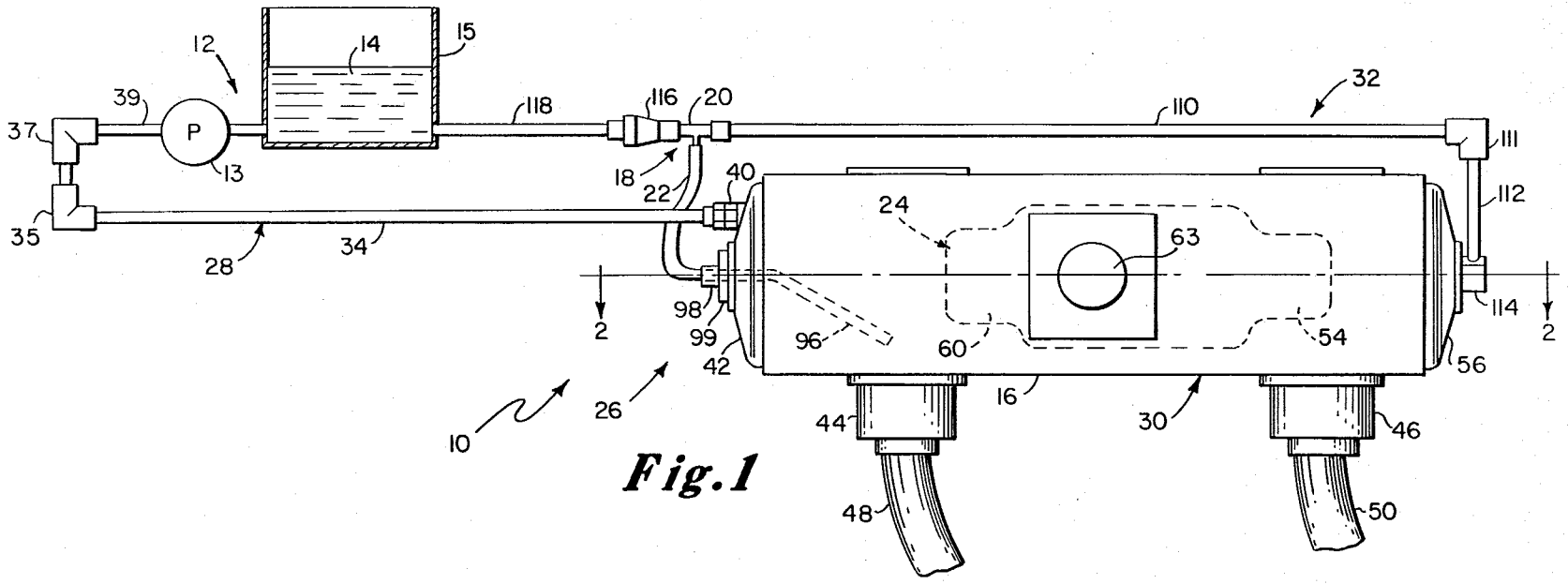
FIG. 1 is a schematic view of a fluid cooled X-ray generator system having the venturi device of this invention connected externally of the X-ray generator housing.

Referring to the drawings wherein like characters of reference designate like parts, there is shown in FIG. 1 an X-ray generator system 10 including a pressurized fluid source 12 disposed to direct dielectric coolant fluid 14, under pressure, through a radiation shielded housing 16 and, at a relatively lower pressure, through a purging means 18 comprising a venturi device 20. The venturi device 20 has a portion communicating through a suction tubing 22 with an interior portion of the housing 16, which may have a generally hollow cylindrical configuration for enclosing an X-ray tube 24. As a result of the pressure differential between the fluid 14 in housing 16 and the fluid 14 passing through the venturi device 20, a dynamic flow of fluid is established in the tubing 22 whereby fluid drawn from the interior portion of housing 16 is directed to the purging means 18 for removal of any foreign gaseous matter therein.

The pressurized fluid source 12 comprises a pump 13 hydraulically connected to a reservoir 15 of suitable dielectric coolant fluid 14, such as a conventional X-ray transmissive oil, for example. Source 12 is disposed for directing the fluid 14 serially through an input leg portion 28, a load portion 30 comprising X-ray generator housing 16, and an output leg portion 32 of a fluid conductive network 26 which also may include, as a branch leg, the suction tubing 22 connecting the purging means 18 to the housing 16. The fluid conductive network preferably is of the closed loop type having the output leg portion 32 connected back to the source 12 for the purpose of recirculating the fluid 14 through the fluid conductive network 26.

Input leg portion 28 may comprise a plurality of conduits and fittings, such as conduit 34 having one end portion communicating with the source 12 through a series connected pair of elbow fittings, 35 and 37, respectively, and a conduit 39 which is connected to the pump 13, for example. Conduit 34 has an opposing end portion communicating with the interior of housing 16 by way of a suitable connector fitting 40 which is eccentrically disposed in an adjacent end wall 42 of the housing. The housing 16 is provided with a conventional pair of spaced horn-type electrical receptacles, 44 and 46, respectively, which supply electrical power to X-ray tube 24 by receiving plug-type end portions of respective electrical cables 48 and 50, such as shown in U. S. Pat. No. 3,982,059 granted to Holland et al and assigned to the assignee of this invention, for example.

Figure 2:
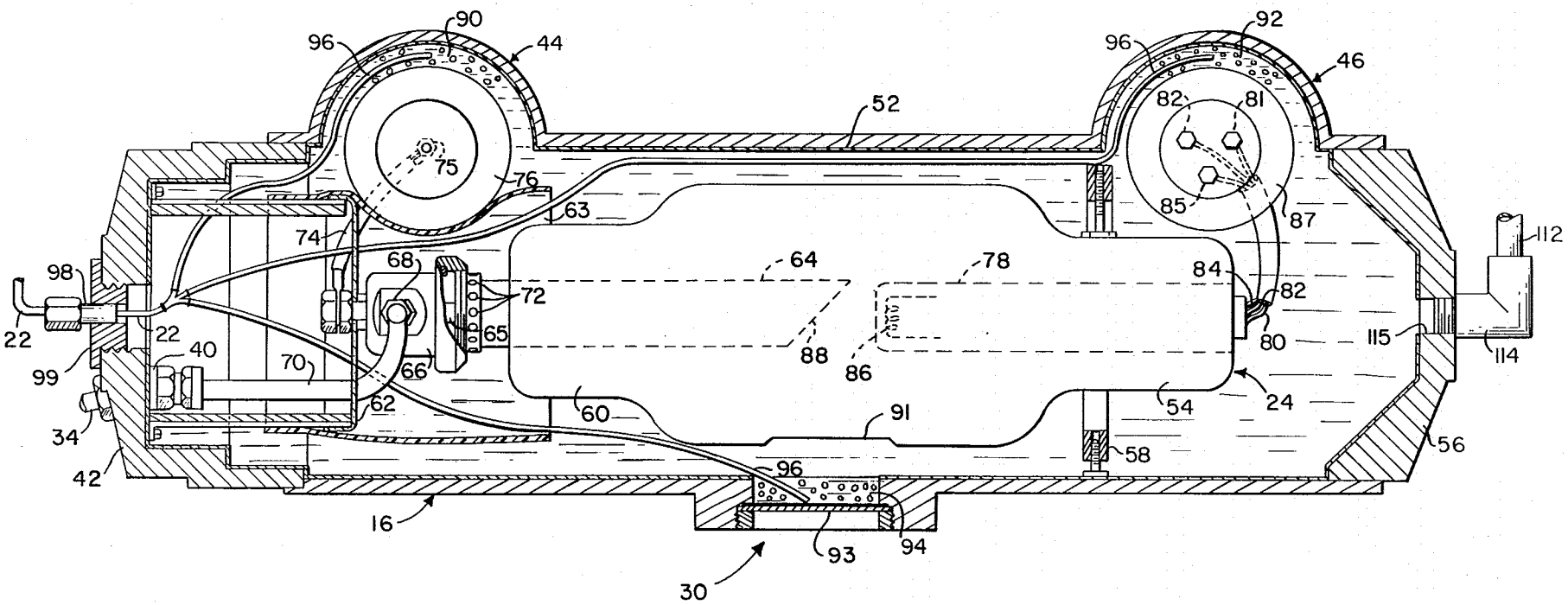
FIG. 2 is an enlarged schematic view of the X-ray generator housing shown in FIG. 1.

As shown more clearly in FIG. 2, inner wall surfaces of housing 16 are provided with a lining 52 of X-ray impervious material, such as lead, for example. A cathode end portion 54 of tube 24 is disposed adjacent an opposing end wall 56 of housing 16 and is supported in spaced relationship with the lining 52 by conventional means, such as dielectric spider member 58 encircling the cathode end portion 54 of tube 24, for example. An opposing anode end portion 60 of tube 24 is disposed adjacent the end wall 42 of housing 16 and is insulatingly supported in spaced relationship with the lining 52 by a conventional structural member 62 which is secured by suitable means to the end wall 42. The structural member 62 may support an axially extending dielectric sleeve 63 in interposed relationship with the electrical receptacle 44 and the adjacent anode end portion 60 of X-ray tube 24. Thus, the anode end portion 60 of tube 24, wherein the heat to-be dissipated is developed, is disposed adjacent the fitting 40 where the dielectric coolant fluid 14 enters the housing 16.

Disposed in the end portion 60 of tube 24 is an anode electrode 64 having an external end portion 65 which may be provided with a conventional coupling device 66 for circulating dielectric coolant through the anode electrode 64, such as shown in U. S. Pat. No. 2,886,724 granted to G. W. Steen on May 12, 1959, for example. Coupling device 66 includes a entrance port 68, which is connected through a flexible conduit 70 to the connector fitting 40 in end wall 42, and a plurality of exit ports 72 communicating with the interior of housing 16. Thus, the dielectric coolant fluid 14 entering housing 16 through fitting 40 is directed through the conduit 70 and entrance port 68 to circulate through the anode electrode 64 and carry heat away therefrom. Subsequently, the fluid 14 emerges from the exit ports 72 of coupling device 66 to flow through the interior of housing 16.

The external end portion 65 of anode electrode 64 extend through the coupling device 66 and is electrically connected to an anode conductor 74. Anode conductor 74 extends to the electrical receptacle 44 and is electrically connnected therein to a terminal 75. Terminal 75 protrudes axially through a cylindrical insulator 76 which is spaced from adjacent portions of the lining 52 by an interposed arcuate recess 90. Accordingly, a high voltage, such as a positive seventy-five kilovolts with respect to system ground, for example, may be applied to the anode electrode 64 during operation of tube 24.

Within X-ray tube 24, the anode electrode 64 is disposed in spaced relationship with a cathode electrode 78 which includes an electron emitting element 86, such as a tungsten filament, for example. The electron emitting element 86 is connected to a pair of filament supply conductors, 80 and 82, respectively, which extend hermetically out of the cathode end portion 54 of the tube 24. Conductors 80 and 82 are electrically connected to respective terminals 81 and 83 in electrical receptacle 46. The receptacle 46 also has a high voltage terminal 85 which is connected through a conductor 84 to the cathode electrode 78 whereby a voltage, such as a negative seventy-five kilovolts with respect to system ground, for exampld, may be applied to the cathode electrode during operation of tube 24. The terminals 81, 83, and 85, respectively, protrude from a cylindrical insulator 87 which is spaced from adjacent portions of the lining 52 by an interposed arcuate recess 92.

Thus, the filament supply conductors 80 and 82, respectively, direct a relatively high current through the electron emitting element 86 of cathode electrode 78 for heating the element 86 to operating temperatures where electrons are emitted copiously therefrom. Also, the high voltage conductors, 74 and 84, respectively, apply an electron beaming voltage, such as one hundred and fifty kilovolts, for example, between the anode electrode 64 and the cathode electrode 78 to beam electrons emitted from the element 86 onto a target portion 88 of the anode electrode with sufficient energy to generate X-rays. As a result, X-rays radiate from the target portion 88 in a beam (not shown) which passes through a window portion 91 of tube 24 and through an aligned port 93 in the housing 16 to emanate from the X-ray generator 30.

Since a large portion of the electron energy beamed onto the target portion 88 of anode electrode 64 is converted into heat, it is imperative that this heat be dissipated before damaging the anode electrode. Accordingly, the system 10 is provided with a pressurized fluid source 12 for forcing dielectric coolant fluid 14, under pressure, through housing 16 for the purpose of conducting heat away from the X-ray tube 24. However, it has been found that foreign gaseous matter, such as air bubbles, for example, may seep into the dielectric fluid 14 in housing 16, particularly after extended idle periods when such seepage is allowed to build-up. Once in the dielectric coolant fluid, these air bubbles are trapped and generally migrate to respective arcuate recesses 90 and 92 in the electrical horn-type receptacles 44 and 46, as by differences in height causing a head pressure, for example.

Thus, these bubbles of air reduce the dielectric strength of the coolant fluid 14 in very critical regions of the housing 16, that is, in the electrical receptacles 44 and 46 where relatively high voltages are applied to the conductors 74 and 84, respectively. Also, bubbles of other foreign gaseous material, such as hydrogen, for example, may accumulate in a region 94 of fluid 14 aligned with the port 93 through which an X-ray beam passes to emerge from the radiation shielded housing 16. Accordingly, these critical regions of housing 16 have disposed therein open end portions of respective branch tubings 96 which have other end portions connected to an end portion of the suction tubing 22 extended within housing 16.

Figure 3:
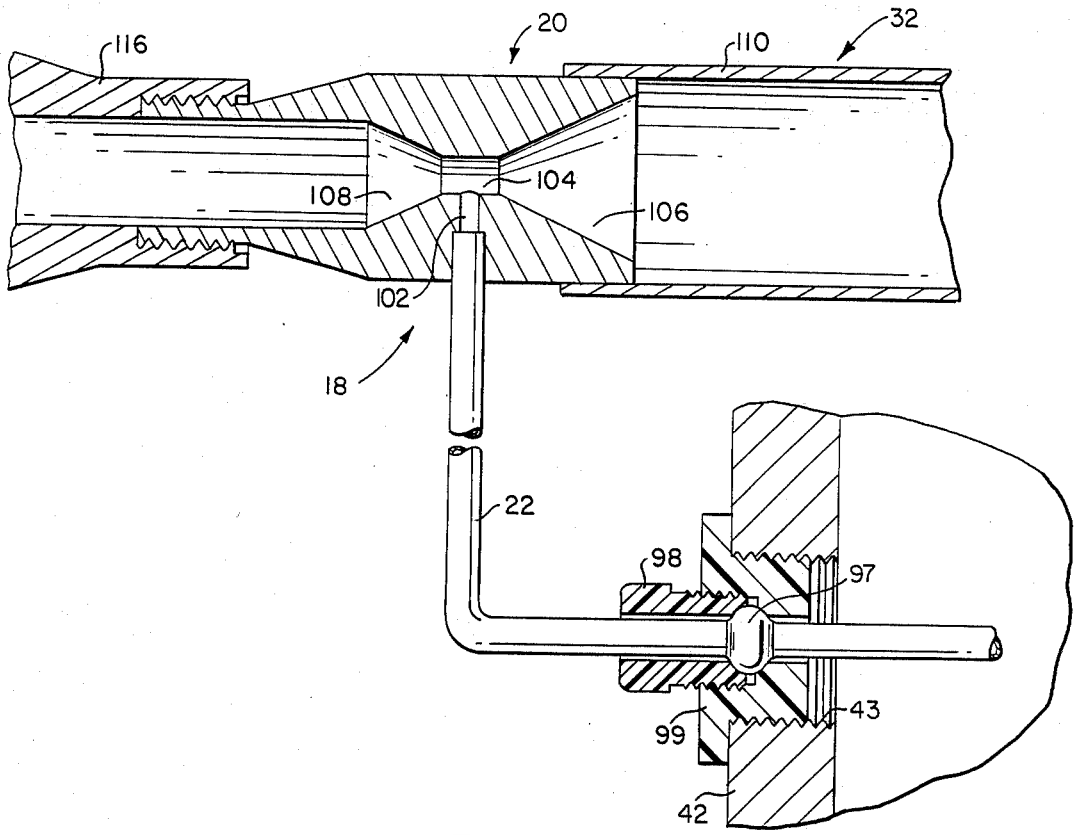
FIG. 3 is an enlarged fragmentary elevational view, partly in section, showing the venturi device of this invention connected to the X-ray generator housing in FIG. 2.

As shown more clearly in FIG. 3, the suction tubing 22 is extended through the end wall 42 of housing 16 in a suitable fluid-tight manner, such as an encircling ferrule 97 compressed by a bushing 98 being journalled into a filler plug 99 which is threadingly mounted in a central aperture 43 in end wall 42, for example. Externally of housing 16, the suction tubing 22 is connected by conventional means to a suction port 102 of the venturi device 20 comprising purging means 18. The suction port 102 extends laterally from a restricted fluid passage 104 which is axially aligned with an entrance passage portion 106 and an exit passage portion 108 having relatively larger inside diameters than the restricted passage 104. Venturi device 20 is connected into the output leg portion 32 of the fluid conductive network to communicate with the output of housing 16 which may comprise a conduit 110 connected through an elbow fitting 111 to another conduit 112, for example. The conduit 112 is connected to a conventional connector fitting 114 which is disposed in a central aperture 115 in the end wall 56 of housing 16 to receive therefrom the flow of fluid 14 and direct it through the output leg portion 32 to the purging means 18. The exit passage portion 108 of venturi device 20 is connected through a quick-disconnect fitting 116 and a conduit 118 to the reservoir 26 of source 12.

Thus, the fluid 14 directed, under pressure, through the housing 16 and returning to reservoir 15 through leg portion 32 passes, at a reduced pressure through the restricted passage 104 of venturi device 20. Consequently, the fluid 14 in critical regions of housing 16, such as 90, 92, and 94, for examples, is at a respective localized pressure $P_1$; and the fluid 14 in restricted passage 104 of device 20 is at a pressure $P_2$ which is less than $P_1$. The pressure differential ($P_1$-$P_2$) thus established between the free end portions of the branch tubings 96 and the remote end portion of tubing 22 attached to device 20, functions as a small suction pump to draw fluid 14 and any foreign gaseous matter therein into the open end portions of branch tubings 96. Accordingly, there is set up in the tubing 22 a dynamic flow of fluid and any air bubbles therein from the critical regions of housing 16 to the suction port 102 of device 20. In the restricted passage 104 of device 20, the dynamic flow of fluid and any air bubbles therein merge with the flow of fluid 14 from the entrance passage 106 to the exit passage 108 of the device 20. Consequently, the air bubbles drawn from critical regions of housing 16 are carried to the reservoir 15 where they rise to the surface of the fluid 14 therein and pass out of the system 10.

Figure 4:
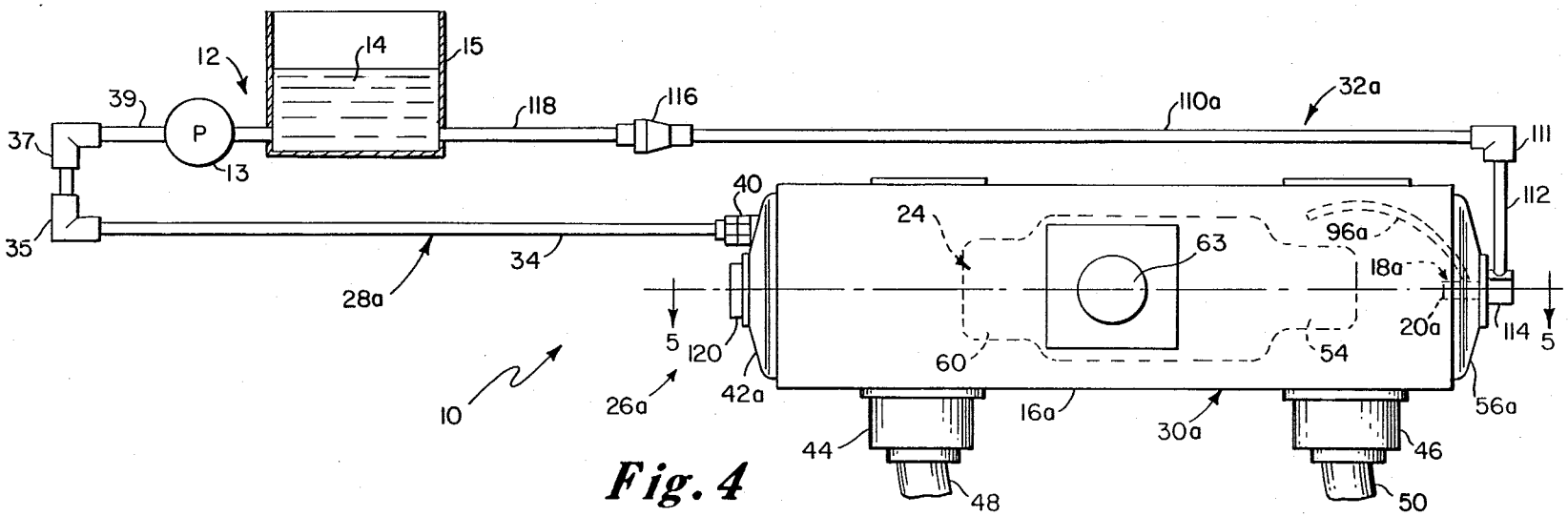
FIG. 4 is a schematic view of an alternative fluid cooled X-ray generator system having the venturi device of this invention connected internally of the X-ray generator housing.

In FIG. 4, there is shown an alternative embodiment comprising an X-ray generator system 10A which is similar to the X-ray generator system 10 shown in FIG. 1 but has a purging means 18A installed within an X-ray generator housing 16A. System 10A includes the pressurized source 12 comprising pump 13 connected to reservoir 15 of dielectric coolant fluid 14. The source 12 in system 10A is disposed for directing the fluid 14, under pressure, through a fluid conductive network 26A including input leg portion 28, a load portion 30A comprising radiation shielded housing 16A wherein X-ray tube 24 may be disposed for operation, and an output leg portion 32A. As in system 10, for example, the output leg portion 32A may be connected back to the source 12 for recirculating the fluid 14 through the fluid conductive network 26A of system 10A. However, unlike system 10, the fluid conductive network 26A of system 10A does not include a branch leg, such as suction tubing 22 shown in FIG. 1, for example.

Figure 5:
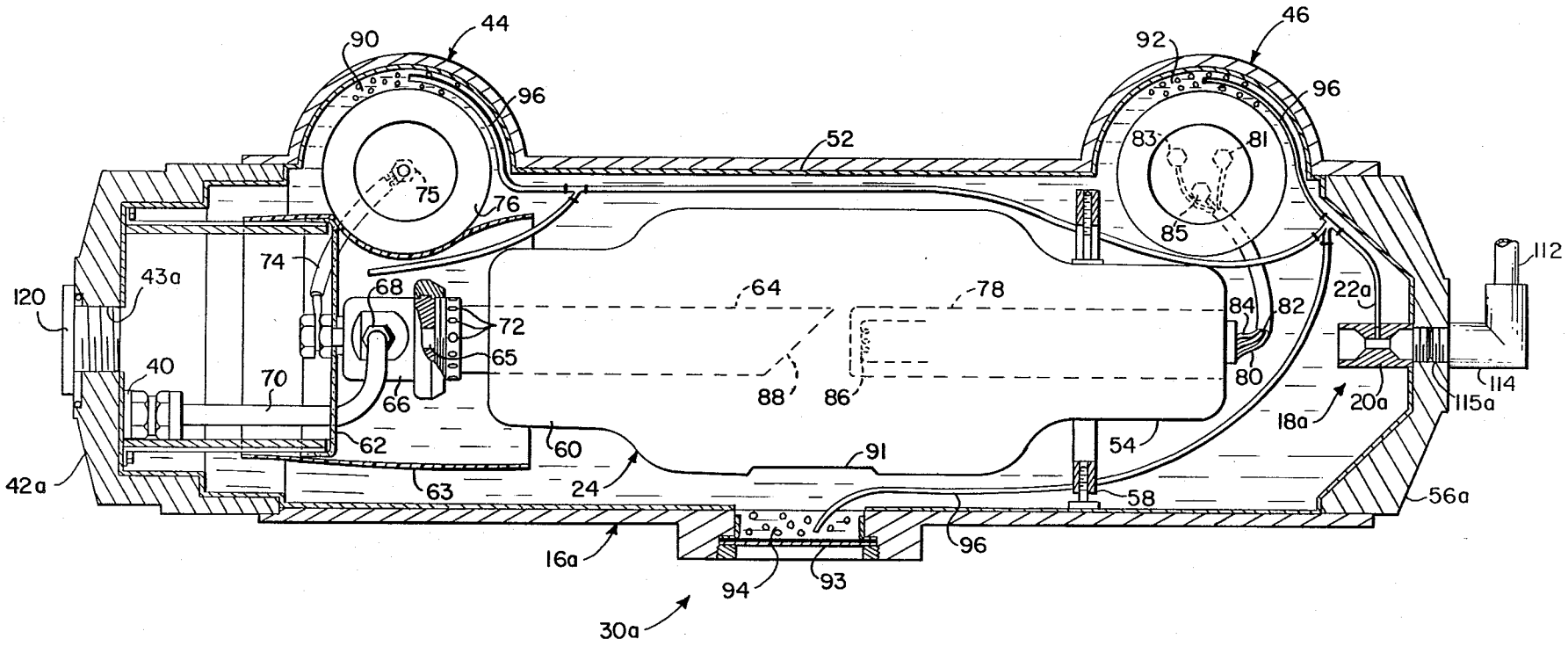
FIG. 5 is an enlarged schematic view of the X-ray generator housing shown in FIG. 4.

As shown in FIG. 5, the X-ray generator housing 16A may have a hollow cylindrical configuration closed at one end by end wall 42A which has a central aperture 43A closed-off in a fluid-tight manner, as by a conventional filler plug 120 being sealed therein, for example. Eccentrically disposed in end wall 42A is the feedthrough connector 40 through which the input leg portion 28 of fluid conductive network 26A connects the source 12 to the interior of housing 16A. Within housing 16A, the connector 40 communicates through flexible conduit 70 with entrance port 68 of coupling device 66. The coupling device 66 is secured to an external end portion 65 of anode electrode 64, which is disposed within an adjacent end portion 60 of X-ray tube 24. The external end portion 65 of anode electrode 64 is insulatingly supported by a member 62, which also supports a dielectric sleeve 63 in interposed relationship with horn type electrical receptacle 44 and the anode end portion 60 of tube 24. External end portion 65 of anode electrode 64 is electrically connected through a conductor 74 to a high voltage terminal 75 of the electrical receptacle 44.

The anode electrode 64 is disposed in spaced aligned relationship with a cathode electrode 78 in an opposing end portion of the X-ray tube 24 which is insulatingly supported by conventional means, such as dielectric spider member 58, for example. Cathode electrode 78 includes an electron emitting element 86 which has a pair of filament conductors 80 and 82, respectively, extended hermetically out of tube 24 and are electrically connected to respective filament terminals 81 and 83 of electrical receptacle 46. A high voltage terminal 85 of receptacle 46 is electrically connected through a conductor 84 to the cathode electrode 78.

Thus, the X-ray tube 24 is disposed in housing 16A for operation whereby electrons emitted from the electron emitting element 86 of cathode electrode 78 are beamed onto a target portion 88 of anode electrode 64. The electrons are beamed with sufficient energy to generate an X-ray beam (not shown) which passes through a window portion 91 of the tube 24 and an aligned port 93 in housing 16A to emerge from the X-ray generator housing. As a result, heat is developed in the anode electrode 64 and is conducted therefrom by fluid 14 passing through the entrance port 68 of coupling device 66 and flowing through the anode electrode 64. Subsequently, the fluid 14 emerging from exit ports 72 of the coupling device 66 flows along X-ray tube 24 and toward an opposing end wall 56A of housing 16A. Extending inwardly of housing 16A from a central aperture 115A in end wall 56 is a purging means 18A comprising a venturi device 20A through which the fluid 14 flows. The fluid 14 emerging from housing 16A passes through output leg portion 32A to return to the source 12.

Figure 6:
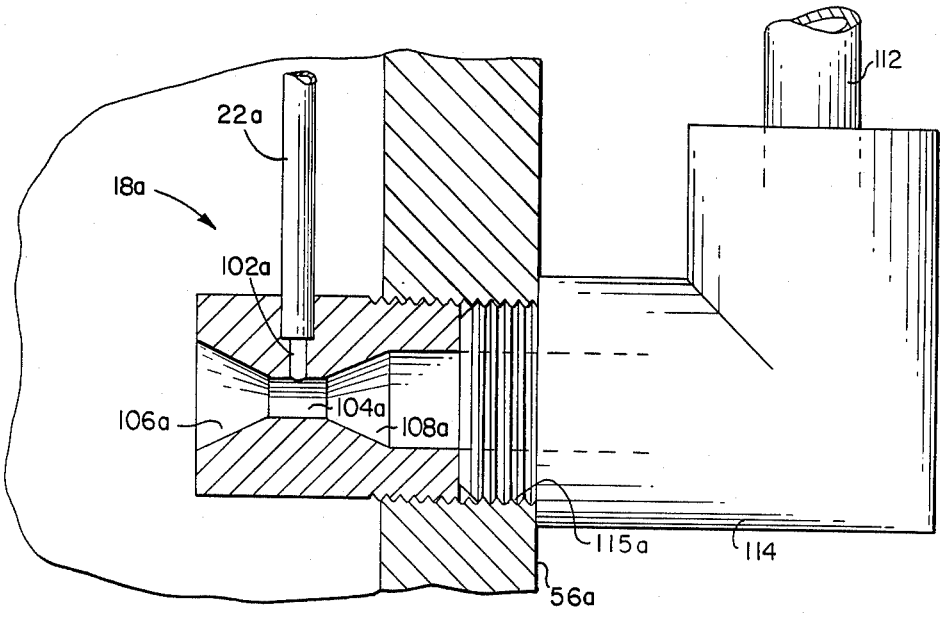
FIG. 6 is an enlarged fragmentary elevational view, partly in section, showing the venturi device of this invention connected to the X-ray generator housing in FIG. 5.

As shown more clearly in FIG. 6, an inner end portion of central aperture 115A in end wall 56A may be internally threaded for receiving therein an exit end portion of the venturi device 20A. The exit end portion of device 20A has disposed therein an exit passage 108A which tapers radially inward to merge with an intermediate restricted passage 104A of relatively smaller diameter. An opposing entrance end portion of device 20A has disposed therein an entrance passage 106A which also tapers radially inward to merge with intermediate restricted passage 104A of relatively smaller diameter. Communicating with the restricted passage 104A is a radially extending, suction port 102A which is connected through a suction tubing 22A with respective end portions of branch tubings 96A. The branch tubings 96A have respective other end portions which are open and disposed in critical regions of the housing 16A, such as arcuate recess 90 in receptacle 44, arcuate recess 92 in receptacle 46, and in the region 94 adjacent port 93, for examples.

Thus, the fluid 14 flowing, under pressure, through the housing 16A passes, at a reduced pressure, through the restricted passage 104A to emerge from housing 16A and return through output leg portion 32A to source 12. As a result of the pressure differential between fluid 14 in restricted passage 104A and fluid 14 in housing 16A, a dynamic flow of fluid 14 and any air bubbles therein is drawn from the critical regions of housing 16A and into adjacent open end portions of branch tubings 96A. This dynamic flow of fluid and any air bubbles therein passes through the suction tubing 22A and emerges at the suction port 104A of venturi device 20A where it merges with the flow of fluid 14 passing through the restricted passage 106A. Accordingly, the air bubbles are carried with the fluid 14 through the output leg portion 32A to the reservoir 15, where they rise to the surface of the fluid 14 therein and pass out of the system. In this manner, foreign gaseous matter is removed from critical regions of housing 16A where it may reduce the dielectric strength of the dielectric coolant fluid 14 or interfere with the X-ray beam emanating from X-ray tube 24.

From the foregoing, it will be apparent that all of the objectives of this invention have been achieved by the structures shown and described herein. It also will be apparent, that various changes may be made by those skilled in the art without departing from the spirit of the invention as expressed in the appended claims. It is to be understood, therefore, that all matter shown and described herein is to be interpreted as illustrative and not in any limiting sense.

What is claimed is:

1. An electron tube apparatus comprising:

an electron tube enclosure having therein a pair of member means spaced apart for producing an electrical potential difference therebetween; and fluid means connected to said enclosure for directing a flow of dielectric liquid therethrough, a portion of said dielectric liquid being disposed between said member means;

said fluid means including suction means for selectively withdrawing said portion of said liquid from between said member means and venting means for purging gaseous matter in said withdrawn portion of said liquid.

2. An electron tube apparatus as set forth in claim 1 wherein said suction means includes a venturi device.

3. An electron tube apparatus comprising:

an electron tube enclosure having therein a pair of member means spaced from one another by an interposed region of the enclosure for maintaining said member means at respective different electrical potentials; and fluid means connected to said enclosure for directing dielectric liquid therethrough, a portion of said liquid in said enclosure being disposed in said region thereof at a first pressure;

said fluid means including differential pressure producing means for producing a second pressure at a point different from said region in response to a flow of the dielectric liquid directed through said differential pressure producing means; and said fluid means including conduit means connected between said differential pressure producing means and said region for producing a flow of said portion of said liquid in said region relative to said region.

4. An electron tube apparatus as set forth in claim 3 wherein said second pressure is less than said first pressure for selectively withdrawing liquid from said region of the enclosure and merging it with said flow of dielectric liquid directed through said differential pressure producing means.

5. An electron tube apparatus as set forth in claim 3 wherein said differential pressure producing a restricted passage portion of a venturi device and the conduit means includes a suction port of the venturi device.

6. An X-ray tube system comprising:

an X-ray tube enclosure having therein a pair of member means spaced from one another by an interposed region of the enclosure for maintaining said member means at respective different electrical potentials;

pressurized fluid means for directing a coolant dielectric liquid along a predetermined path and at a first pressure through said enclosure;

venturi means including a restricted passage portion disposed in said path for having said dielectric liquid flow at a lower pressure thorugh said restricted passage portion than through said enclosure, and including a suction port disposed in communication with said restricted passage portion; and conduit means connected between said suction port and said region of said enclosure for selectively withdrawing liquid and gaseous matter therein from said region to said restricted passage portion and merging said withdrawn liquid and gaseous matter therein with said dielectric liquid flow through said restricted passage portion.

7. An X-ray tube system as set forth in claim 6 wherein said venturi means is disposed externally of said enclosure.

8. An X-ray tube system as set forth in claim 6 wherein said venturi means is disposed within said enclosure.

9. An X-ray generator system comprising:

an X-ray generator including a housing having an electrically conductive inner wall surface and having insulatingly mounted therein electrical means for generating X-rays, said electrical means including an X-ray tube electrically connected to electrical conductor means for applying electrical power to respective electrodes of the tube, a portion of said electrically conductive inner wall surface of said housing being insulated from a portion of said electrical means by an interposed space within the housing;

a source of dielectric coolant liquid connected to said housing for flowing of said coolant liquid therethrough and providing further insulation between said inner wall surface of the housing and said electrical means; and means connected to said housing for selectively withdrawing liquid and any gas therein from said space between said portion of the electrically conductive inner wall surface and said portion of the electrical means and for purging said gas from the said dielectric liquid to maintain the dielectric isolation properties of said fluid in said housing.

10. An X-ray generator system as set forth in claim 9 wherein said gas purging means comprises a venturi device including a restricted passage portion disposed for having said fluid flow therethrough at a reduced pressure as compared to the pressure of said fluid in said housing.

11. An X-ray generator system comprising:

an X-ray generator including a housing having therein an X-ray tube electrically connected to a plurality of spaced terminals for applying electrical power to respective electrodes of the tube;

a source of dielectric coolant liquid connected to said housing for flowing of said coolant liquid therethrough and providing further dielectric insulation between said terminals; and means connected to said housing for selectively withdrawing liquid and gas therein from a portion of said housing and purging said gas from said liquid to reduce the effect of said gas in degrading the dielectric properties of the coolant.

* * * * *